US007168430B2

(12) United States Patent
Grothaus

(10) Patent No.: US 7,168,430 B2
(45) Date of Patent: Jan. 30, 2007

(54) LAMP DEVICE ON A PRODUCTION MACHINE FOR THE MANUFACTURE OF PRODUCTS OF THE TOBACCO-PROCESSING INDUSTRY AS WELL AS ASSOCIATED LAMP

(75) Inventor: Frank Grothaus, Hamburg (DE)

(73) Assignee: Hauni Maschinenbau AG, Hamburg (DE)

( * ) Notice: Subject to any disclaimer, the term of this patent is extended or adjusted under 35 U.S.C. 154(b) by 32 days.

(21) Appl. No.: 10/849,799

(22) Filed: May 21, 2004

(65) Prior Publication Data

US 2005/0007762 A1 Jan. 13, 2005

(30) Foreign Application Priority Data

May 24, 2003 (EP) ..... 03090157

(51) Int. Cl.
*A24C 5/32* (2006.01)
*H05B 37/00* (2006.01)

(52) U.S. Cl. ..... 131/280; 315/312; 315/316; 315/322

(58) Field of Classification Search ..... 362/234, 362/253, 800; 315/312, 316, 322, 323, 324; 131/280, 290, 299
See application file for complete search history.

(56) References Cited

U.S. PATENT DOCUMENTS 3,743,418 A * 7/1973 Heflinger ..... 356/5.04
3,816,636 A * 6/1974 Peltz ..... 84/687
4,090,189 A * 5/1978 Fisler ..... 315/169.1
4,145,569 A * 3/1979 Ehrat ..... 380/262
4,373,806 A 2/1983 Tipper
4,754,759 A * 7/1988 Allocca ..... 607/46
5,222,799 A 6/1993 Sears et al.
6,116,748 A 9/2000 George
6,220,724 B1 4/2001 Krokeide
2002/0006039 A1 1/2002 Ueda et al.
2003/0184995 A1* 10/2003 Seibert et al. ..... 362/90
2005/0116748 A1* 6/2005 Deppe ..... 327/112

FOREIGN PATENT DOCUMENTS

DE 10024284 11/2001
DE 10110835 9/2002
JP 03135850 * 6/1991 ..... 362/500

* cited by examiner

*Primary Examiner*—Sandra O'Shea
*Assistant Examiner*—Mark Tsidulko
(74) *Attorney, Agent, or Firm*—Greenblum & Bernstein P.L.C.

(57) ABSTRACT

Machine for making tobacco-processing industry products includes a plurality of lamps arranged on components of the machine. Each lamp includes at least one visible light-emitting power semiconductor light source. An electronic mode control unit is electrically connected to and controlling the lamps. The electronic mode control unit is structured and arranged to control the lamps so as to provide uniform continuous light for illuminating at least one of the components and the tobacco-processing industry products, and is structured and arranged to control the lamps so as to provide periodically interrupted light for illuminating at least one of the components and the tobacco-processing industry products. This Abstract is not intended to define the invention disclosed in the specification, nor intended to limit the scope of the invention in any way.

18 Claims, 4 Drawing Sheets

LAMP DEVICE ON A PRODUCTION MACHINE FOR THE MANUFACTURE OF PRODUCTS OF THE TOBACCO-PROCESSING INDUSTRY AS WELL AS ASSOCIATED LAMP

CROSS-REFERENCE TO RELATED APPLICATIONS

The present application claims priority under 35 U.S.C. § 119 of European Patent Application No. 03 09 0157.3 filed May 24, 2003, the disclosure of which is expressly incorporated by reference herein in its entirety.

BACKGROUND OF THE INVENTION

1. Field of the Invention

The invention concerns a lamp device on a high-speed production machine for the manufacture of products of the tobacco-processing industry, wherein there is provided a system of lamps which are arranged stationarily on the machine in the region of machine components, in order to observe machine components each operated according to a machine control cycle and/or passing products. The invention also relates to a specially adapted lamp.

2. Discussion of Background Information

A known device for monitoring the adjustment of individual machine components on production machines for manufacturing articles of the tobacco-processing industry has stroboscope lamps which are permanently installed at selected locations of the production machine (DE-A-1 100 24 284). The stroboscope lamps are controllable in time with the machine by electronic trigger control means. In practice, however, instead of permanently installed stroboscope lamps, transportable stroboscope flash lamps to be held by hand are used. Such a lamp is used only when faults arise, requiring the observation of a virtually still image of the process while the machine is running. Reasons for this are manifold. One particular requirement is machine lighting with particularly bright continuous light, in order on the one hand to observe the operation of machine components through transparent protective covers. On the other hand, continuous illumination is to be ensured with maximum light intensity for cleaning, maintenance and troubleshooting. For these purposes, fluorescent lamps which are permanently installed on machine components are used. Of course, uniform illumination with continuous light is achieved, but the lamps take up considerable assembly space. For structural reasons, in practice it is not possible to provide stroboscope lamps in addition to the lamps with continuous light. It is precisely in locations where illumination with stroboscope light is wanted that there are considerable problems regarding assembly, light quality, direction of radiation and assembly space. Added to this is the fact that the additional installation of a plurality of stroboscope lamps is uneconomical. One must therefore be content with the transportable manual stroboscope lamp to find an illuminating position which seems suitable for observing a defective process while the protective cover is removed by holding the flash lamp manually and changing its position experimentally. Apart from the fact that this handling while the protective covers are open on a machine which is running means considerable risk, which is tolerated, it is moreover tedious and cannot readily be reproduced. Conventional gas-discharge flash lamps are used because their illumination is inherently relatively high. Insofar, even an excessively high light intensity is applied in order to obtain acceptable light conditions also with a reduced production cycle with which the light intensity of a clock-controlled gas-discharge flash lamp automatically drops back. The high-speed production machines referred to have special characteristics which make special demands on light technology to be specifically adapted. Movement cycles are particularly sensitive and fast. Machine components must, without breakdown, master production speeds which are around 200 to 400 steps/s. For the articles to be made, as well as for products or components thereof, a plurality of components must cooperate precisely at maximum speed in order to perform operations of conveying, transfer and processing at numerous positions of a production line. Accordingly, the components are designed differently for intermittent movements, in particular in the form of conveying drums, rotating cutting members, sliding, aligning, rolling and turning means, rotating adhesive and printing members as well as drive members. In particular for high-output operation, the adjustment and cooperation of all the aforementioned elements are extremely important for obtaining unhindered production flow and a perfect result of production. In addition to illumination with continuous light, the production of still images of the very rapidly proceeding operations within all speed ranges is of substantial significance. With high-speed operation are associated special acceleration and braking stages which are also to be detected. Here, not only is the lighting technology to meet requirements of operation and condition monitoring as well as maintenance, but also characteristic fault patterns are to be detectable, and operational adjustments by detecting and varying characteristic production stages are to be feasible. The known lamp devices for the aforementioned special machines of the tobacco-processing industry do not meet the sum of the aforementioned requirements.

SUMMARY OF THE INVENTION

One main aim of the invention is to provide a multi-functional lamp device on the aforementioned production machines of the tobacco-processing industry. In particular, a particularly high degree of integration of equipment functions and an adapted design conforming to the machines are to be achieved, in order to use light from one and the same light source optionally as continuous light or stroboscope light for observation, maintenance, troubleshooting, fault analysis and/or machine adjustment. Here, the quality of the light is to be equally good for all functional areas even with the most varied requirements. An integrated lamp construction is to be simple and cheap. It is also the aim to obtain a device with a long service life and high operational reliability. Such multi-functional lamps are to be, in each case, capable of being mounted in a very narrow space and of being oriented easily and efficiently towards the spot to be illuminated.

The aims of the invention are obtained in conjunction with the characteristics of the lamp device mentioned hereinbefore, by the fact that each lamp is formed by at least one visible light-emitting power semiconductor light source, in particulars a light-emitting diode, or by at least one corresponding pulse-controllable light-emitting element, and wherein the device includes an electronic mode control unit electrically connected to the lamps for optionally adjustable operation of the lamps, wherein, on the one hand, operation with uniform continuous light for illuminating machine components and/or products and, on the other hand, operation with stroboscope light periodically interrupted according to the machine control cycle for producing virtual images which show movement cycles of machine components and/or products, can be set. According to the invention, the result is that the system of lamps whose semiconductor light sources are controllable by way of pulse sequences can be used multi-functionally. It is of particular advantage that, with one and the same mechanisms, on the one hand, long-life continuous lighting with high-power homogeneous light for illuminating machine components over wide lighting ranges is available, and, on the other hand, in the stroboscope mode hitherto unknown precision and flexibility for troubleshooting, monitoring, resetting and adjustment are obtained. It is also of substantial significance that each lamp can be mounted in a very narrow space. On account of high-power operation in all modes, maximum light intensities with optimum illumination ranges are obtained. With the system of the plurality of lamps in the production machine, measurement results at different locations in the machine can be compared. The high-speed technology of the special machines of the tobacco industry can be mastered. Particularly quick fault location is achieved in combination with increased machine availability. Typical product flaws, for example, impressions on cigarettes, can be located quickly, easily and reliably in relation to a drum which causes them in the machine. In high-speed operation too, glue pattern checks and corrections in the paper movement can be made. For instance, the glue pattern can also be precisely monitored and adjusted for cutting on a tumbling drum. Incorrect product positions on a drum or movements of the product on the drum can be detected quickly and reliably. With stroboscope monitoring, the stability of flow of cigarette filters is ensured. In stroboscope operation, assemblies can easily be adjusted, for example, for band rolling. Generally, effective monitoring and resetting of machine components during machine operation is to be singled out. In particular, on-line resetting of the transfer of products between drums can be carried out quickly and reliably. Between continuous-light mode and stroboscope-light mode, easy and quick, machine-adapted switching and control are achieved. The universal lamps integrated in the machine avoid trial or experimental orientations of the light sources for all modes of operation. Individual measurements which impede reproducibility are eliminated. A machine equipped with the lamp system can be operated safely with the protective covers closed. A system of cheap, long-life semiconductor light sources for machine illumination with continuous light and for producing virtual images with stroboscope light is available. On the whole, a relatively simple, multi-functional, operationally reliable lighting system which is cheap and technically easy to integrate in a machine and ensures a relatively long service life is obtained.

In order to advantageously achieve automatic switching between stroboscope operation while the machine is running and continuous lighting when the machine is at a standstill, for a continuous-light mode the mode control unit can appropriately be switched to a switching state in which at least one lamp remains free from control by the mode control unit, wherein the lamp is supplied directly with supply voltage, preferably d.c. voltage. Appropriately the lamp is then equipped with at least one electronic diode control circuit which can be switched selectively to two switching states so as to switch between clocked and direct unclocked light-emitting diode voltage supply as a function of the presence or absence of a clock control signal of the mode control unit.

One particular embodiment provides for a continuous-light mode wherein the mode control unit can be switched to a switching state in which it supplies at least one lamp with a control signal which has a pulse sequence and whose pulse frequency is asynchronous to the frequency of the machine cycle within the lighting range of the lamp. Appropriately, pulse frequencies of about 450 to 500 Hz are set to obtain excellent asynchronicity in relation to a high-speed production cycle of the order of e.g., 200 to 400 Hz.

A preferred embodiment of the mode control unit of the lamp device further provides for a stroboscope mode wherein the control unit can be switched to a switching state in which it supplies at least one lamp with a control signal which has a pulse sequence and whose pulse frequency is kept synchronous with the machine production cycle within the lighting range of the lamp. In this setting, a virtually still image of the conveyed product or intermediate product is produced on a machine component such as e.g., a drum or a trough. Appropriately, it may also be provided that for a stroboscope mode the mode control unit can be switched to a switching state in which it generates a control signal which acts on at least one lamp and has a pulse sequence and which is generated with a variable clock offset deviating from the clock synchronicity of the control cycle with the machine cycle within the lighting range of the lamp. This frequency shift which deviates slightly from synchronicity may be positive or negative, to produce a movement of the machine component and/or product which is virtually slowed down in a forward or backward direction on the production line.

According to a further embodiment, in a stroboscope mode the mode control unit can appropriately be switched to a switching state in which it generates a control signal which acts on at least one lamp and has a pulse sequence and which is generated with a variable phase displacement between the control cycle and the machine cycle within the lighting range of the lamp. By way of such a phase displacement, which may be negative or positive, an object or product which appears still is shifted in its movement position by an amount corresponding to the adjustment in a forward or backward direction.

In a particularly preferred embodiment, the mode control unit is designed in such a way that it generates a control signal controlling at least one lamp with a mark-to-space (make-break) ratio of a pulse sequence which is kept constant while the machine cycle varies within the lighting range of the lamp, independently of such a variation. As a result, the light intensity of the lamp remains constant at different machine speeds or even at machine speeds varying to a great extent, e.g., when braking or accelerating.

In order to appropriately and advantageously make the light intensity of stroboscope light and/or continuous light variable within a predetermined range, in an embodiment of the invention the mode control unit is switched so as to generate a control signal controlling at least one lamp with a mark-to-space ratio of a pulse sequence which is variable within a predetermined range.

Particularly appropriately and advantageously, the mode control unit of the lamp device is connected in electrical circuit with a central drive control arrangements of a production machine equipped with the lamps, in order to control the lamps in accordance with and/or as a function of operating states of the production machine. The mode control unit is then equipped with an electronic trigger circuit with which at least one and preferably each lamp is triggered in stroboscope mode automatically with the machine cycle associated with the respective lighting point. With the lamps coupled to the system cycle of the drive system and to the cycle reductions which are possible as a result, individual drives with associated machine components can be observed and adjusted individually. Still images are generated uninfluenced by or independently of a change in the respective machine speed. At the same time movement operations at several points of a production machine can be observed particularly well both in the acceleration stage and in the braking stage.

Appropriately, the mode control unit of the lamp device can also be connected in electrical circuit with control elements of a control station of a production machine for individually controlling the lamps. For example, for particular adjustment in a stroboscope mode a trough or drum cycle as well as the assembly or drum to be observed can be selected. In a cigarette-making machine, for example, a front or rear continuous rod is selected to obtain a still image of the cigarettes of one continuous rod in a double-rod machine. A production machine is appropriately equipped with a handwheel as the control element, in order to switch on the stroboscope-light mode with a machine mode display, if necessary, and to make adjustments conveniently.

An advantageous lamp particularly well adapted for the purposes of the lamp device according to the invention includes at least one rod-like, elongate base whose surface facing towards the lamp radiation side is designed as a mounting surface having an inclination, on which several light-emitting diodes are arranged in a row along the base with the orientation of radiation corresponding to the inclination. This lamp is especially compact, ensuring optimum illumination along a machine component to be lit. Particularly advantageously, the lamp may include a rod-like elongate housing with at least one assembly chamber which extends in its longitudinal direction and which is divided into a chamber holding the diode-mounting base and a chamber which extends longitudinally with the latter chamber, and in which can be arranged at least one electronic unit for lamp control.

On the whole, according to the invention there is provided a lamp device on a high-speed production machine for the manufacture of products of the tobacco-processing industry, which is equipped with a special mode control unit which is electrically connected to the lamps comprising semiconductor light sources and operates as an electronic light switch and which generates control signals controlling the lamps and including pulse signals. By way of the pulse signals, selected lamps are switched to optionally variable operation with continuous light and stroboscope light periodically interrupted according to the machine control cycle for generating virtual images showing the movement cycles of machine components and/or products. Appropriately and advantageously, in at least one mode the mark-to-space ratio of the respectively driving control signal is variable for controlling the light intensity. Not only power semiconductor light sources, but also light sources which can be operated for continuous-light operation and accordingly in conjunction with pulse control are suitable as light-emitting elements.

The invention also provides for a machine for making tobacco-processing industry products, wherein the machine comprises a plurality of lamps arranged on components of the machine. Each lamp comprises at least one visible light-emitting power semiconductor light source. An electronic mode control unit is electrically connected to and controls the lamps. The electronic mode control unit is structured and arranged to control the lamps so as to provide uniform continuous light for illuminating at least one of the components and the tobacco-processing industry products, and is structured and arranged to control the lamps so as to provide periodically interrupted light for illuminating at least one of the components and the tobacco-processing industry products.

The machine may comprise a high-speed production machine. The lamps may allow a user to observe the components. The lamps may allow a user to observe the tobacco-processing industry products. The lamps may allow a user to observe the tobacco-processing industry products passing within the machine and according to a machine control cycle. The at least one visible light-emitting power semiconductor light source may comprise a light-emitting diode. The periodically interrupted light may comprise stroboscope light. The periodically interrupted light may be controlled according to a machine control cycle, whereby virtual images are produced which show movement cycles of at least one of the components and the tobacco-processing industry products. The electronic mode control unit may be adapted to switch to a state wherein at least one of the lamps remains uncontrolled by the electronic mode control unit, whereby the at least one lamp is supplied directly with a supply voltage. The supply voltage may be a direct current voltage.

At least one of the lamps may be adapted to be selectively switched to two switching states. At least one of the lamps may be adapted to be selectively switched between a state which uses a clocked voltage supply and a state which uses a direct unclocked voltage supply. At least one of the lamps may be selectively switchable between states based on a presence or absence of a clock control signal of the electronic mode control unit.

The electronic mode control unit may be adapted to be switched to a switching state in which at least one of the lamps is supplied with a control signal having a pulse sequence. The pulse sequence may comprise a pulse frequency which is asynchronous relative to a frequency of a machine cycle of the machine. The switching state may occur during a continuous light mode of the electronic mode control unit. The pulse sequence may comprise a pulse frequency which is synchronous relative to a frequency of a machine cycle of the machine. The switching state may occur during a stroboscope light mode of the electronic mode control unit.

The electronic mode control unit may be adapted to generate a control signal controlling at least one of the lamps. The control signal may have a mark-to-space ratio (P/P) of a pulse sequence which is kept constant relative to a variable machine control cycle of the machine. The control signal may have a mark-to-space ratio (P/P) of a pulse sequence which is independent of a variable machine control cycle of the machine. The control signal may have a mark-to-space ratio (P/P) of a pulse sequence which is variably adjustable. The control signal may have a mark-to-space ratio (P/P) of a pulse sequence which is variably adjustable within a predetermined range so as to vary a light intensity of at least one of the uniform continuous light and the periodically interrupted light. The electronic mode control unit may be adapted to be switched to a switching state in which at least one of the lamps is supplied with a control signal having a pulse sequence generated with an adjustable clock offset. The adjustable clock offset may deviate from a clock synchronicity of a control cycle. The switching state may occur during a stroboscope light mode of the electronic mode control unit.

The electronic mode control unit may be adapted to be switched to a switching state in which at least one of the lamps is supplied with a control signal having a pulse sequence generated with an adjustable phase displacement.

The adjustable phase displacement may occur between a control cycle and a machine control cycle of the machine. The switching state may occur during a stroboscope light mode of the electronic mode control unit. The electronic mode control unit may be electrically connected to a central drive control system of the machine. The lamps may be controllable based on operating states of the machine. The electronic mode control unit may be electrically connected via an electrical circuit to a central drive control system of the machine. The electronic mode control unit may be electrically connected to control elements of a control station of the machine. The electronic mode control unit may be structured and arranged to individually control each of the lamps. The electronic mode control unit may be electrically connected via an electrical circuit to control elements of a control station of the machine. The plurality of lamps may be arranged on at least one rod-like elongate base. The plurality of lamps may comprise LED lamps. The at least one rod-like elongate base may comprise an inclined mounting surface. The plurality of lamps may be arranged on the inclined mounting surface. The plurality of lamps may be arranged in a row on the inclined mounting surface.

The plurality of lamps may be arranged on at least one rod-like elongate housing. The at least one rod-like elongate housing may comprise at least one longitudinally extending assembly chamber. The at least one rod-like elongate housing may comprise a chamber and a diode-mounting base.

The invention also provides for a method of illuminating portions of the machine for making tobacco-processing industry products as described above, wherein the method comprises arranging a plurality of lamps on components of the machine and controlling the plurality of lamps with the electronic mode control unit.

The invention also provides for a machine for making tobacco products, wherein the machine comprises a plurality of lamps arranged on components of the machine, each lamp comprising at least one visible light source, and an electronic control unit controlling the lamps, wherein the electronic control unit controls the lamps so as to provide uniform continuous light and so as to provide periodically interrupted light.

The invention also provides for a method of illuminating portions of the machine for making tobacco-processing industry products of the type described above, wherein the method comprises arranging a plurality of lamps on components of the machine and controlling the plurality of lamps with the electronic control unit.

The invention also provides for a machine for making tobacco products, wherein the machine comprises a plurality of lamps arranged on components of the machine, each lamp comprising at least one LED, and an electronic control unit individually controlling each of the lamps, wherein the electronic control unit controls the lamps so as to provide uniform continuous light and so as to provide periodically interrupted light.

The invention also provides for a method of illuminating portions of the machine for making tobacco-processing industry products of the type described above, wherein the method comprises arranging a plurality of lamps on components of the machine and controlling the plurality of lamps with the electronic control unit.

Other exemplary embodiments and advantages of the present invention may be ascertained by reviewing the present disclosure and the accompanying drawings.

BRIEF DESCRIPTION OF THE DRAWINGS

Particularly appropriate and advantageous embodiments or possible designs of the invention are described in more detail with the aid of the following description of the practical examples shown in the schematic drawings wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
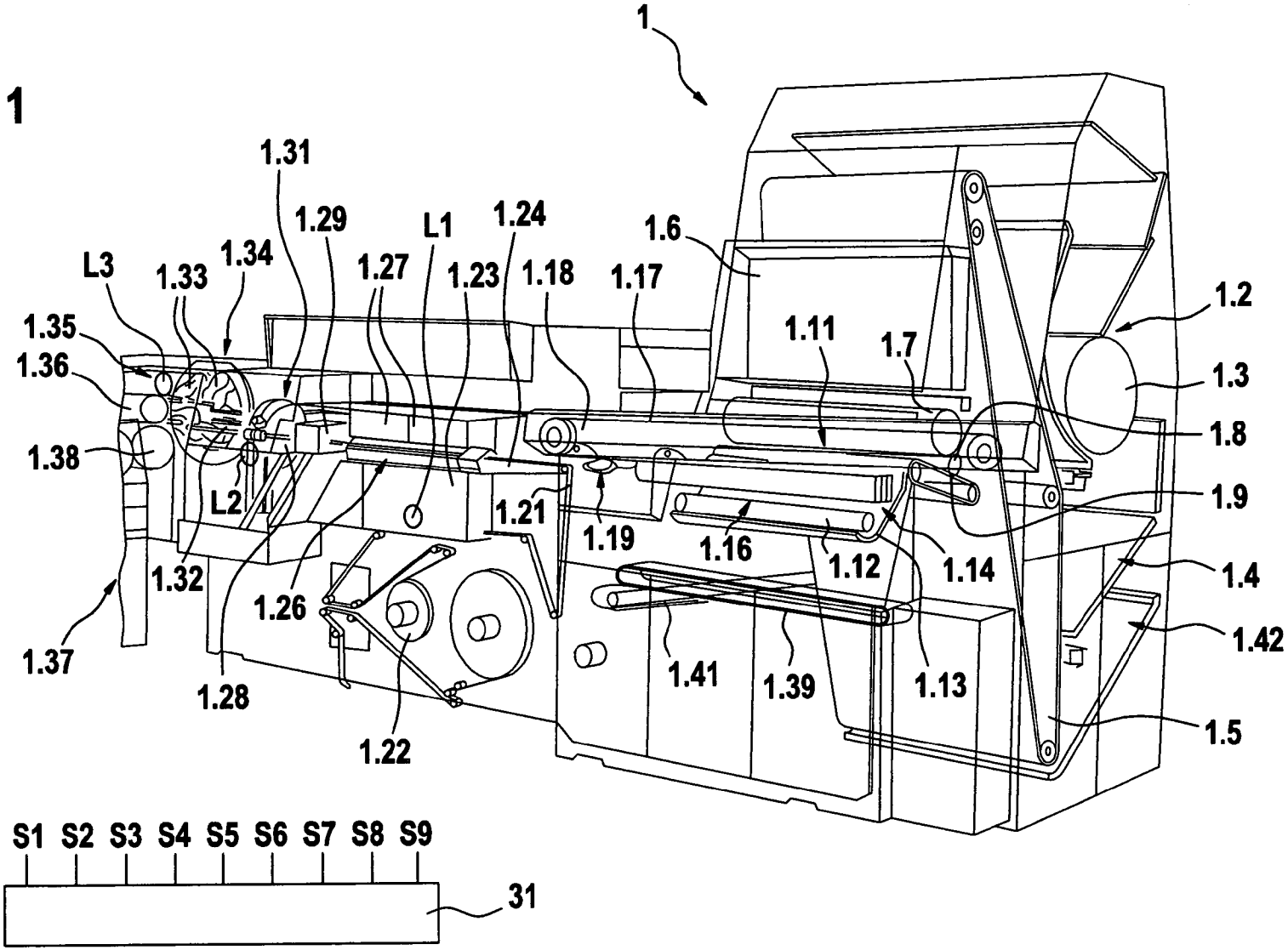
FIG. 1 in an axonometric view a cigarette-making machine equipped with lamps of a lamp device according to the invention, showing the transfer zone for transferring continuous tobacco rod sections to a production machine for filter cigarettes.
Figure 2:
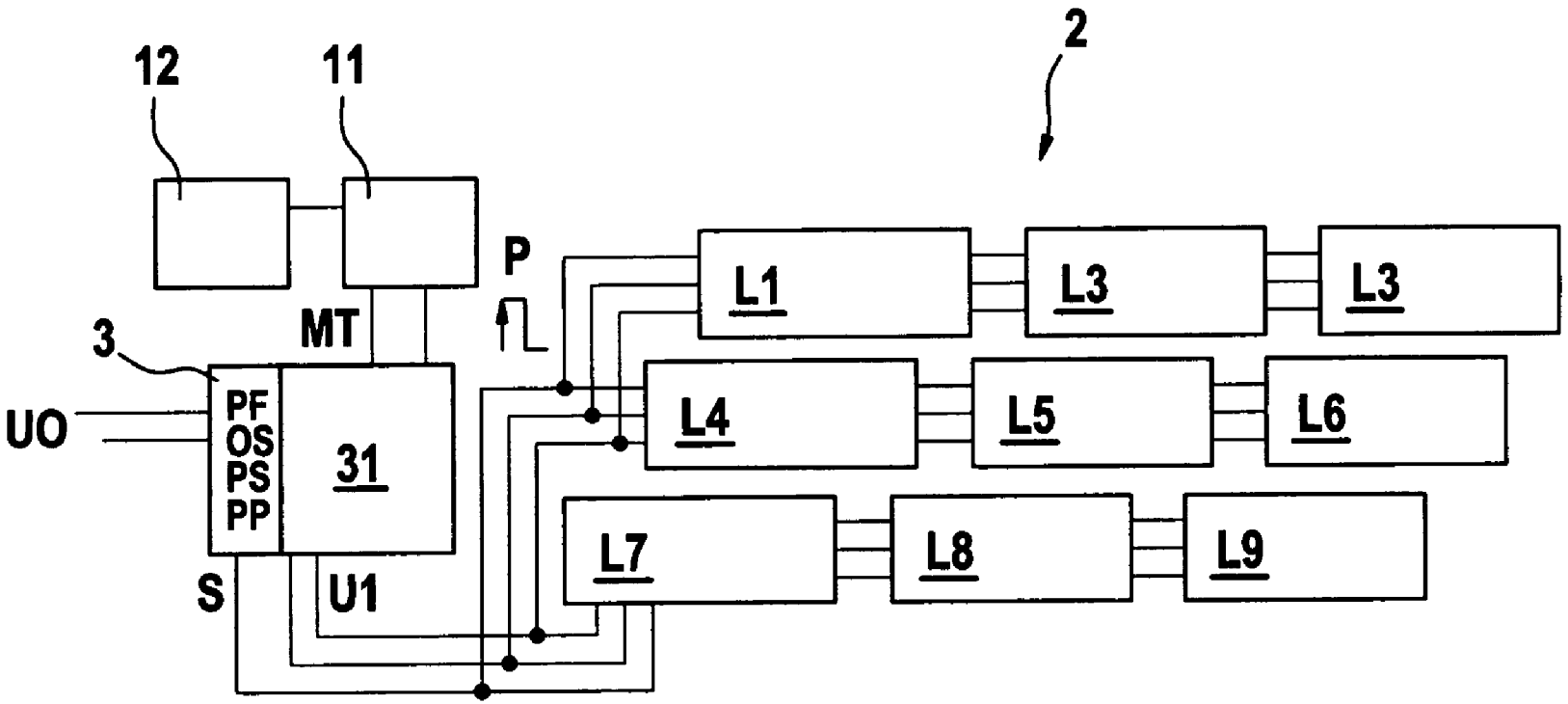
FIG. 2 in a block diagram the general structure of a lamp device according to the invention.

A lamp device 2 according to the invention, as shown in FIG. 2, includes a system of lamps L1 to L9, of which three lamps L1 to L3 are arranged stationarily on a cigarette-making machine 1 as in FIG. 1. The lamp L1 is provided on a print unit 1.23, the lamp L2 on a blade apparatus 1.31 and the lamp L3 at an interface 1.35 between the cigarette-making machine 1 and a filter-attaching machine 1.37. The lamp device 2 has a mode control unit (drive unit) 3. Part of the control unit 3 is an appropriately microprocessor-controlled electronic drive unit shown in FIG. 1 in the form of a trigger control unit 31, which is supplied with one or more machine speed-dependent signals of a machine drive control system 11. Thus the lamps L1 to L9 are acted upon by associated control signals S1 to S9 having a pulse sequence according to the machine cycle or according to the cycle controlling the machine MT.

Figure 3:
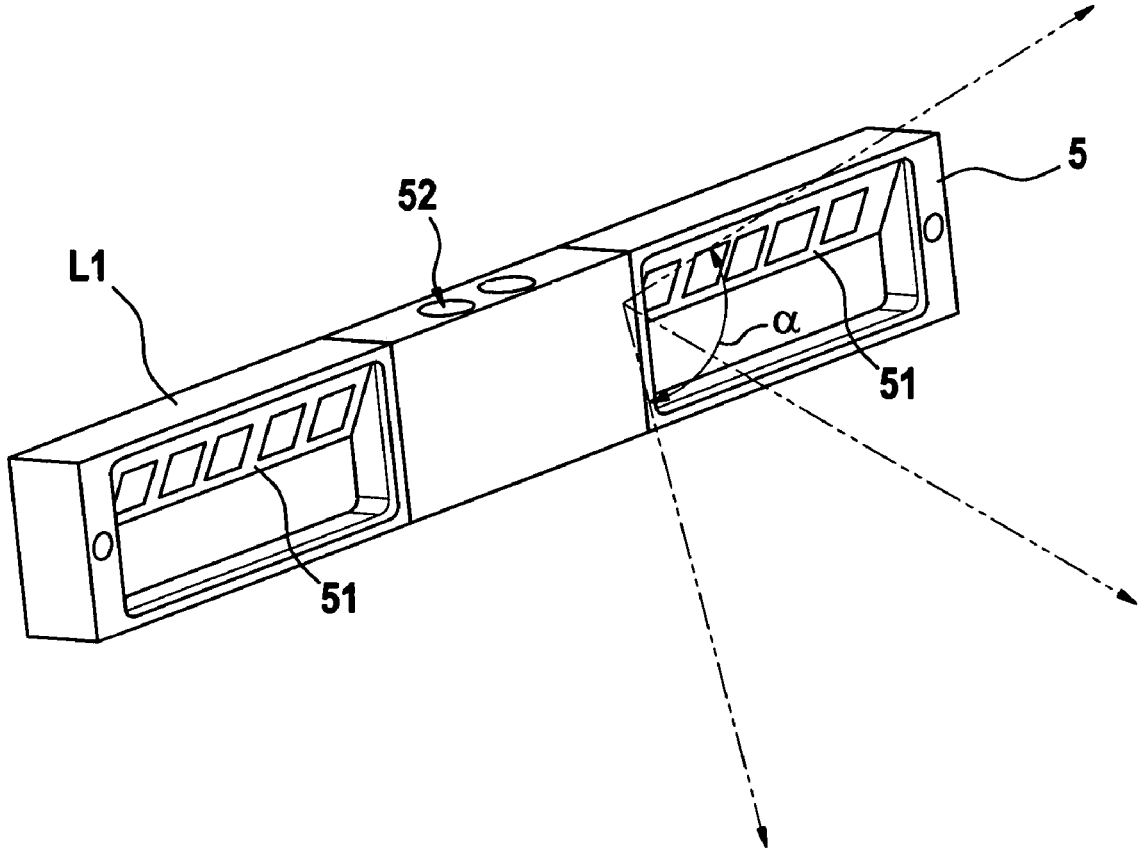
FIGS. 3 and 4 in an axonometric view a lamp according to the invention of a lamp device according to the invention.
Figure 4:
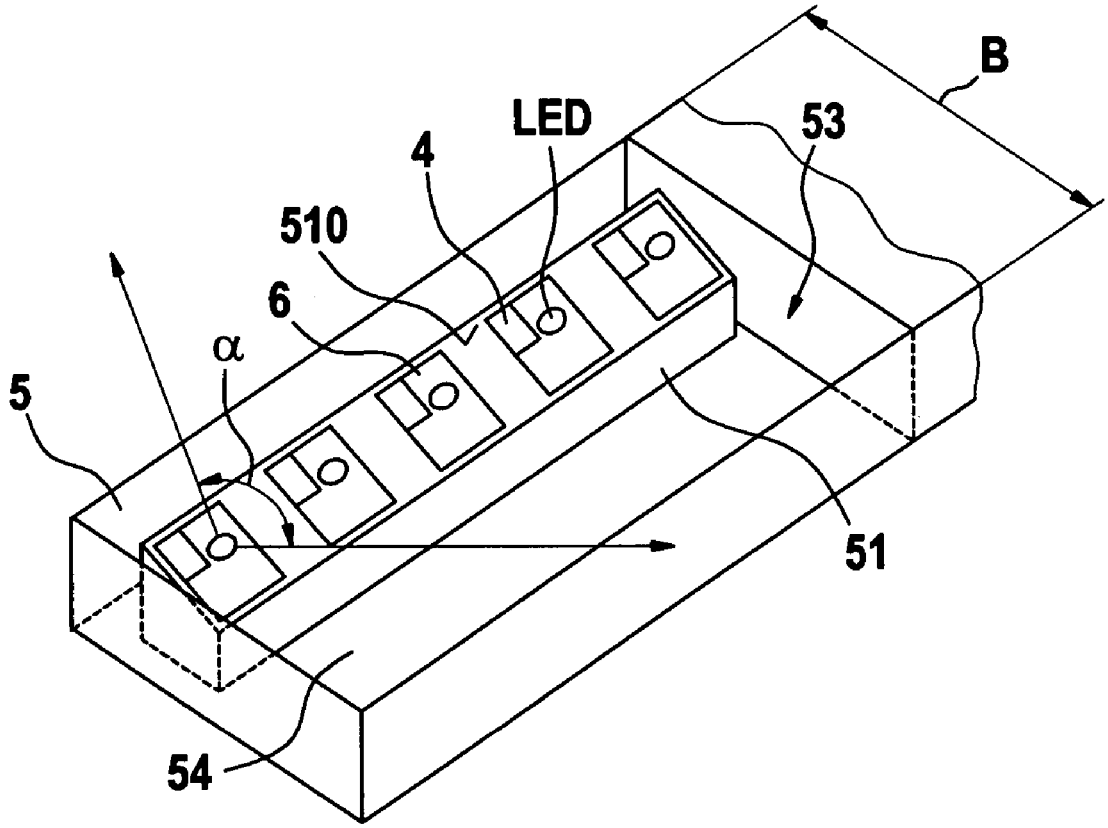

According to the practical example of FIGS. 3 and 4, each lamp L1 to L9 is formed by a group of ten power light-emitting diodes LED. Such diodes are commercially available and obtainable e.g., with a power of one watt. As can be seen from FIG. 4, each light-emitting diode is arranged on a small rectangular board 6 which also holds an electronic diode control circuit 4 belonging to the diode. Each diode produces homogeneous, colorless (neutral) light.

Usually, a production line for making cigarettes is defined by a cigarette-making machine, a filter-attaching machine and an adjoining packing machine. Such clock-controlled, continuously operating production machines are known and described in more detail in DE 100 24 284, for example. Here, in connection with the lamp device 2 according to the invention only the cigarette-making machine 1 is described in more detail. A preliminary distributor 1.2 is supplied with tobacco in portions. A take-off roller 1.3 of the preliminary distributor 1.2 tops up with tobacco in a controlled fashion a storage container 1.4 from which a steep-angle conveyor 1.5 takes tobacco and supplies an accumulating shaft 1.6 in a controlled fashion. From the accumulating shaft 1.6, a pin roller 1.7 takes a uniform stream of tobacco which is knocked out of the pins of the pin roller 1.7 by a knock-out roller 1.8 and spun onto a scatter blanket 1.9 rotating at constant speed. A tobacco fleece formed on the scatter blanket 1.9 is spun into a sifting device 1.11 which essentially utilizes an air curtain through which pass larger or heavier tobacco particles, while all other tobacco particles are deflected by the air into a funnel 1.14 formed by a pin roller 1.12 and a wall 1.13. From the pin roller 1.12 the tobacco is spun into a tobacco channel 1.6 against a continuous rod conveyor 1.17 on which the tobacco is held by way of air sucked into a vacuum chamber 1.18 and onto which a continuous tobacco rod is showered. An equalizer 1.19 removes surplus tobacco from the continuous tobacco rod which is then laid on a strip of cigarette paper 1.21 guided in synchronization. The strip of cigarette paper 1.21 is taken off a reel 1.22, guided through a print unit 1.23 and laid on a driven format belt 1.24. The format belt 1.24 transports the tobacco rod and the strip of cigarette paper 1.21 through a former 1.26 in which the strip of cigarette paper 1.21 is folded round the tobacco rod, so that one edge still projects, to which glue is applied by a gluing apparatus, not shown, in a known manner. Next, the adhesive seam is closed and dried by a tandem seam plate 1.27. A continuous cigarette rod 1.28 formed in this way passes through a rod density measuring device 1.29 which controls the equalizer 1.19, and is cut by a blade apparatus 1.31 into double-length cigarettes 1.32. The double-length cigarettes 1.32 are transferred by a transfer device 1.34 having controlled arms 1.33 in the region of an interface 1.35 of a take-over drum 1.36 of the filter-attaching machine 1.37 on whose cutting drum 1.38 they are divided with a circular blade into single cigarettes. Conveyor belts 1.39, 1.41 convey surplus tobacco into a container 1.42 which is arranged under the storage container 1.4 and from which the re-circulated tobacco is taken by the steep-angle conveyor 1.54.

With the lamps L1, L2 and L3 installed permanently on the machine 1, optionally the print unit 1.23, the blade apparatus 1.31 and the transfer point 1.35 between the machines 1 and 1.37 are lit with continuous light. On the other hand, the same lamps L1 to L3 can be switched optionally to stroboscope mode by way of the device according to the invention, in order not only to monitor, but also to adjust particularly easily and precisely exact maintenance of the print image and cut as well as satisfactory transfer of cigarettes 1.32 to the filter-attaching machine 1.37. In the process, protective covers on the machine 1 remain closed.

The mode control unit 3 as in FIG. 2 allows universal, multi-functional operation for all lamps L1 to L9. The control unit 3, which is supplied with a d.c. voltage U0 of e.g., 24 V, works as a mode-adjusting or defining electronic light switch and as an electronic trigger circuit. Each lamp L1 to L9 is supplied via a voltage output of the control unit 3 with d.c. voltage U1 of e.g., 24 V, and the voltage or power of each lamp L1 to L9 is controllable with an individual clock control signal S1 to S9 which the control unit 3 generates as a function of the selected and set light mode. A commercial differential driver is used as the output driver.

The signals are transmitted with a 5 V differential signal. In the diagram of FIG. 2 is shown signal transmission via a single control wire with a control signal S such as may be generated differently with signals S1 to S9 arising beside each other for associated lamps L1 to L9. Different signals S1 to S9 can be transmitted in multiplex operation via several logic channels via a single wire or, as shown in FIG. 1, with respectively associated wires. The control signal S or the control signals S1 to S9 contain one or more periodic pulse sequences with pulse frequency PF. Each diode control circuit 4 is prepared and connected in such a way that driving is triggered with rising edges of the pulses P, in order to supply the diodes of the lamps L1 to L9 with a voltage clocked according to the pulse signals.

In the practical example of FIG. 2, each LED lamp L1 to L9 can optionally be operated in three basic modes, this being to produce continuous light without control, continuous light with control, and stroboscope light.

In the continuous-light mode without control, the signal control wire does not transmit a control signal S. The diode control circuit 4 of each lamp L1 to L9 discriminates between the presence or absence of a control clock signal S and accordingly switches automatically between clocked and direct unclocked light-emitting diode voltage supply. Each lamp L1 to L9 is designed and wired with diode and individual diode control circuit 4 in such a way that, in the absence of the clock of the control signal S, it is operated directly with d.c. voltage U1 of typically 24 V.

In the "continuous light with control" mode, the electrical output is controlled to vary and adjust the light intensity of the lamp. The lamp is operated as a dimmer. For this purpose there is generated a control signal S whose pulse frequency PF is asynchronous to the frequency of the machine control cycle MT within the lighting range of the respectively controlled LED lamp L1 to L9. If it is taken into consideration that the high-speed machine cycle is produced with a frequency of the order of 200 Hz to 400 Hz, then appropriately a pulse frequency PF above 450 Hz is chosen. To control the light intensity, the mark-to-space ratio P/P of the pulse sequence is varied and set; variation and setting take place appropriately within the range $1/2<P/P<99/1$. Thus the light intensity of the selected lamp is infinitely variable. This is of particular importance for adapting continuous-light lighting to objects to be observed, to avoid dazzle effects.

In the third mode, the mode control unit 3 switches to stroboscope operation. The lamp which is driven accordingly gives off periodically interrupted light. To produce a virtually still image of the operation to be measured, the control unit 3 is switched to a switching state in which it generates a control signal S whose pulse frequency is kept synchronous with the machine control cycle MT within the lighting range of the LED lamp which is driven. In order to obtain, from the position of the virtually still object, a slow movement of the object in the direction of travel or in the opposite direction in the machine, the mode control unit 3 can be switched to a switching state in which it generates a control signal S which is generated with a variable clock offset OS different to the clock synchronicity of the control cycle with the machine control cycle MT within the lighting range of the LED lamp which is driven. According to the desired direction of movement and observation, a slight upward or downward offset of the frequency from synchronicity is set.

Furthermore, the mode control unit 3 is designed and wired in such a way that the pulse sequence of the control signal S can be displaced and set in its phase position. Starting from an object which is virtually still in case of synchronicity of frequency, this signal can be displaced forward or backward in its travel according to a forward or backward shift of phase.

Whereas, during operation of the control unit 3 with continuous light of variable light intensity, the mark-to-space ratio P/P is varied for illumination with different light intensity, for the stroboscope-light mode the control unit 3 is prepared and wired in such a way that the mark-to-space ratio P/P which varies inherently with variation of the pulse frequency is kept constant in case of pulse frequency variation. As a result of this too, an additional substantial improvement in the quality of illumination or measurement with stroboscope light is obtained. A further property of the mode control unit 3 is that the light intensity of stroboscope light too is continuously variable and adjustable by varying and adjusting the mark-to-space ratio P/P, the constancy in relation to varying pulse frequency PF being maintained. Appropriately a mark-to-space ratio P/P is set within the range of $1/99<P/P<1/2$. Here, the control unit 3 is suitable for generating stroboscope light within a wide frequency spectrum of in particular 3 to 400 Hz.

It can be seen that, with the aid of the modes described, maximum adjustment potential and flexibility are achieved for illuminating, measuring, analysing and/or adjusting product travel or the machine components with one and the same lighting arrangements. To use the adjustment and observation bandwidth optimally, the mode control unit 3 is electrically connected and wired to the drive control system 11 of the production machine equipped with the lamp system. The machine drive control arrangement 11, in turn, is usually managed and run by a memory-programmable control arrangement 12. According to installed or variable programs, in particular states of control elements and/or machine sensors are scanned and associated operations are controlled. In particular, according to the invention the result is that the multi-functional lamp device 2 is operated in combination with a machine display, that is, in conjunction with control panels displaying the machine state and/or mode. If necessary, by way of a machine control element such as a handwheel together with the machine display, continuous-light mode and stroboscope mode can be switched on and set. Using the control arrangements 11, 12 switched with the control unit 3, for example, trough or drum cycle as well as the associated assembly or drum to be observed, and so, for example, in FIG. 1 the region of the take-over drum 1.36 illuminated by the lamp L3, can then be selected deliberately. In particular, the movement of the take-over drum 1.36 can be precisely observed, analysed, adjusted and/or corrected by using the lamp modes described. This manner of analysis and adjustment also makes it possible to classify the type of faults or breakdowns quickly and reliably, namely in particular to demarcate and distinguish between electrical system faults and process errors in the sphere of individual drives. Such observations, measurements and adjustments can be made, on account of the systematic lighting, at several locations in the machine in relation to each other. By way of the control unit 3 in connection with the control arrangements 11, 12, the lamps L1 to L9 in stroboscope mode are coupled to the system cycle MT of the machine drive system, if occasion arises with associated cycle reduction respectively. The control unit 3 is designed in such a way that, when the production machine stops, there is an automatic switch from stroboscope mode to continuous lighting. In the process, first the mode of "continuous light without control" can be switched on automatically, and then if necessary in the mode of "continuous light with control" the light intensity can be reduced or adapted to ensure observation without reflection and dazzling at the desired location. But naturally it is also possible to switch to continuous light in the above-mentioned modes while the production machine is running in order to illuminate desired internal regions in the machine.

Use of the lamp device according to the invention on machines of the tobacco-processing industry which operate at high speed is basically unlimited. In particular, the lamp device according to the invention is also arranged on the filter-attaching machine 1.37 which follows the cigarette-making machine 1 described, there too in locations which are difficult to access and critical for adjustment, in particular over the region of drum transfer points, cutting drums, filter-staggering drums, filter-sliding drums, glue-applying devices, wobble drums, tumbling drums, rolling and turning mechanisms, and braking drums. A cigarette-packing machine too, which in mass flow receives cigarettes from the filter-attaching machine 1.37, is appropriately equipped with the lamp device according to the invention. In particular, the glue pattern during paper movement, cutting on the tumbling drum, the position and/or movement of the product on the drums and troughs, and filter travel, are monitored and adjusted. It can be seen that at practically all locations of a cigarette production line which are critical for operation and/or adjustment, the same light sources can be used by way of the lamp device according to the invention, using controlled multi-functional or hybrid light functions.

As can be seen from FIGS. 3 and 4, a diode lamp L1 according to the invention—the lamps L2 to L9 are correspondingly designed—includes in each case a rod-like, elongate, rectangular housing 5. The housing 5 contains, divided by a central chamber 52 for holding cables, two identical rod-like bases 51 which extend lengthways with the housing 5. Each base 51 has a surface which is designed as a sloping surface 510 facing towards the lamp radiation side. Attached to this sloping surface 510 in a row are five light-emitting diode units each having the diode LED, associated diode control circuit 4 and board 6. A direction of radiation corresponding to the slope is obtained as a result. Each sloping base 51 is arranged in an upper chamber 53 of the housing 5 in relation to the housing width B, while below the lower portion of the sloping base 51 a housing chamber 54 which if necessary can be used to accommodate an electronic circuit, is available. The slope of the base is selected at 25° so as to obtain an eccentric angle of radiation or aperture angle of at least $\alpha=110°$. On the front side of the housing is mounted a light-transmitting protective cover for a window. The lamp shown in the embodiment described as in FIGS. 3 and 4 is particularly small and so can easily be accommodated in a narrow space at the location to be lit. In the group with 2×5 diodes, in spite of separation by the central assembly zone in the bar-type lamp, intensive illumination which is continuous both over the length of the lamp and in the solid angle of radiation of $\alpha=110°$ is obtained, with homogeneous white light which ensures optimum lighting adapted to the location and function, in the different modes of each lamp.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particular disclosed herein; rather the present invention extends to all functionally equivalent structures, methods and uses, such as are within the scope of the appended claims.

The invention claimed is:

1. A machine for making tobacco-processing industry products, the machine comprising:

a plurality of lamps arranged on components of the machine;

each lamp comprising at least one visible light-emitting power semiconductor light source; and an electronic mode control unit electrically connected to and controlling the lamps, wherein the electronic mode control unit is structured and arranged to control the lamps so as to provide uniform continuous light for illuminating at least one of the components and the tobacco-processing industry products, and is structured and arranged to control the lamps so as to provide periodically interrupted light for illuminating at least one of the components and the tobacco-processing industry products, and wherein the electronic mode control unit is electrically connected to a central drive control system of the machine.

2. The machine of claim 1, wherein the lamps are controllable based on operating states of the machine.

3. A method of illuminating portions of the machine for making tobacco-processing industry products of claim 1, the method comprising:

arranging the plurality of lamps on components of the machine; and controlling the plurality of lamps with the electronic mode control unit.

4. A machine for making tobacco-processing industry products, the machine comprising:

a plurality of lamps arranged on components of the machine;

each lamp comprising at least one visible light-emitting power semiconductor light source; and an electronic mode control unit electrically connected to and controlling the lamps, wherein the electronic mode control unit is structured and arranged to control the lamps so as to provide uniform continuous light for illuminating at least one of the components and the tobacco-processing industry products, and is structured and arranged to control the lamps so as to provide periodically interrupted light for illuminating at least one of the components and the tobacco-processing industry products, and wherein the electronic mode control unit is electrically connected to control elements of a control station of the machine.

5. The machine of claim 4, wherein the periodically interrupted light is controlled according to a machine control cycle, whereby virtual images are produced which show movement cycles of at least one of the components and the tobacco-processing industry products.

6. The machine of claim 4, wherein the electronic mode control unit is adapted to be switched to a switching state in which at least one of the lamps is supplied with a control signal having a pulse sequence.

7. The machine of claim 6, wherein the pulse sequence comprises a pulse frequency which is asynchronous relative to a frequency of a machine cycle of the machine.

8. The machine of claim 7, wherein the switching state occurs during a continuous light mode of the electronic mode control unit.

9. The machine of claim 6, wherein the pulse sequence comprises a pulse frequency which is synchronous relative to a frequency of a machine cycle of the machine.

10. The machine of claim 9, wherein the switching state occurs during a stroboscope light mode of the electronic mode control unit.

11. The machine of claim 4, wherein the electronic mode control unit is adapted to generate a control signal controlling at least one of the lamps, and wherein the control signal has a mark-to-space ratio (P/P) of a pulse sequence which is kept constant relative to a variable machine control cycle of the machine.

12. The machine of claim 4, wherein the electronic mode control unit is adapted to generate a control signal controlling at least one of the lamps, and wherein the control signal has a mark-to-space ratio (P/P) of a pulse sequence which is independent of a variable machine control cycle of the machine.

13. The machine of claim 4, wherein the electronic mode control unit is adapted to generate a control signal controlling at least one of the lamps, and wherein the control signal has a mark-to-space ratio (P/P) of a pulse sequence which is variably adjustable within a predetermined range so as to vary a light intensity of at least one of the uniform continuous light and the periodically interrupted light.

14. The machine of claim 4, wherein the electronic mode control unit is adapted to be switched to a switching state in which at least one of the lamps is supplied with a control signal having a pulse sequence generated with an adjustable phase displacement, and wherein the adjustable phase displacement occurs between a control cycle of the electronic mode control and a machine control cycle of the machine.

15. The machine of claim 14, wherein the switching state occurs during a stroboscope light mode of the electronic mode control unit.

16. The machine of claim 4, wherein the electronic mode control unit is structured and arranged to individually control each of the lamps.

17. The machine of claim 4, wherein each lamp comprises at least one LED.

18. A method of illuminating portions of the machine for making tobacco-processing industry products of claim 4, the method comprising;

arranging the plurality of lamps on components of the machine; and controlling the plurality of lamps with the electronic mode control unit.

* * * * *